United States Patent [19]

Stark

[11] 4,169,587

[45] Oct. 2, 1979

[54] PROCESS FOR TRANSFERRING SUPPORTS, AND SUPPORTS FOR USE THEREIN

[75] Inventor: Ludwig Stark, Maeder, Austria

[73] Assignee: Vespa Instruments Establishment, Vaduz, Liechtenstein

[21] Appl. No.: 797,735

[22] Filed: May 17, 1977

[30] Foreign Application Priority Data

May 24, 1976 [CH] Switzerland ..... 6517/76

[51] Int. Cl.[2] ..... B65H 5/00

[52] U.S. Cl. ..... 271/264; 226/92

[58] Field of Search ..... 352/235, 157, 158; 226/92; 271/1, 264, 145, 160, 3, 4

[56] References Cited

U.S. PATENT DOCUMENTS

| | | | |
|---|---|---|---|
| 1,613,379 | 1/1927 | Boniforti | 354/174 |
| 1,746,732 | 2/1930 | Knutsson | 226/128 |

FOREIGN PATENT DOCUMENTS

| | | | |
|---|---|---|---|
| 1008777 | 5/1952 | France | 354/178 |

*Primary Examiner*—Richard A. Schacher

*Attorney, Agent, or Firm*—Young & Thompson

[57] ABSTRACT

The invention relates to a process for transferring supports as well as to supports for use in this process.

The process is characterized by the fact that a support is mechanically driven by means of a driven device and that said mechanically driven support drives at least the next support by means of at least a fold formed on at least a part of the rear border width of said support and coming during its travel motion into coupling with at least another fold, which is formed in the opposite direction to said rear border fold of the previous support, and on at least a part of the fore border width of said next support.

11 Claims, 6 Drawing Figures

FIG. 3
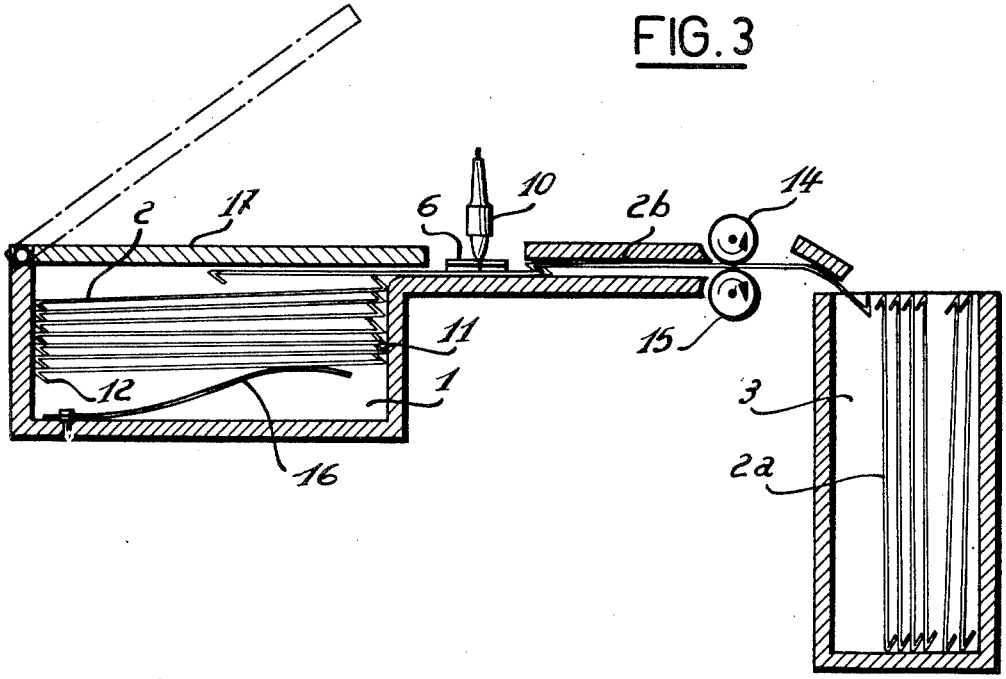
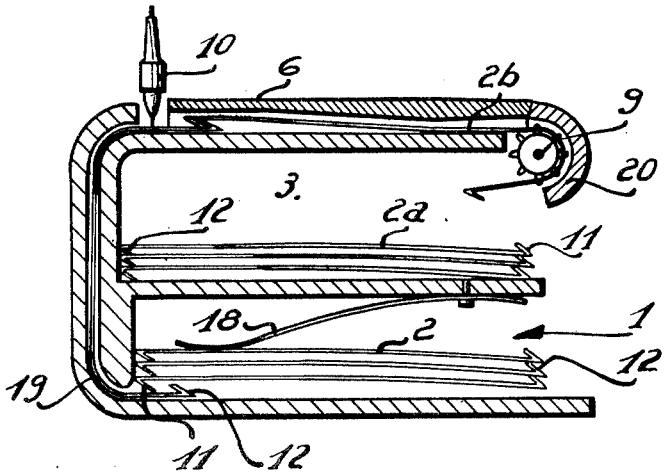
FIG. 4

PROCESS FOR TRANSFERRING SUPPORTS, AND SUPPORTS FOR USE THEREIN

The present invention relates to a process for transferring supports, as to well as supports for use therein. In the following description and claims, the term "supports" represents sheets or preprinted or non preprinted cards, composite sheets, for example constituted by two superimposed bands between which are inserted diapositives, transparent or non transparent films, etc.

For all the recorders, barographs, spectographs, recording apparatuses for checking the operation of a plant, etc., it is necessary either to introduce at predetermined intervals replacement sheets in the apparatus, which is difficult or which must be carried out at a precise time, or to use paper rolls, but then the interpretation of the graphs obtained is complex due to the difficulty of handling these rolls.

The present invention overcomes the above-mentioned disadvantages and the object thereof is accordingly to provide a process for transferring supports, characterized by the fact that a support is mechanically driven by means of a driving device and that said mechanically driven support drives at least the next support by means of at least a fold formed on at least a part of the rear border width of said support and coming during its travel motion into contact with at least another fold, which is formed in the opposite direction to said rear border fold of the previous support and on at least a part of the fore border width of said next support.

Thus, the supports, for example sheets, are drawn out of a pile of blank sheets and pushed into a container of marked sheets where they are laid down in order.

The present invention has for a further object the provision of supports for the practice of the above process, which are distinguished by the fact that they comprise each at least a fold on at least a part of their fore border width and at least a fold, formed in the opposite direction, on at least a part of their rear border width.

The annexed drawings illustrate schematically and by way of example several devices using the present process and the supports for the practice thereof.

FIG. 3 illustrates a third recorder in which the blank sheets pile is horizontal, whereas the marked sheets are stored vertically.

FIG. 4 illustrates a fourth recorder in which the marked and the blank sheets are arranged in superimposed piles.

Figure 1:
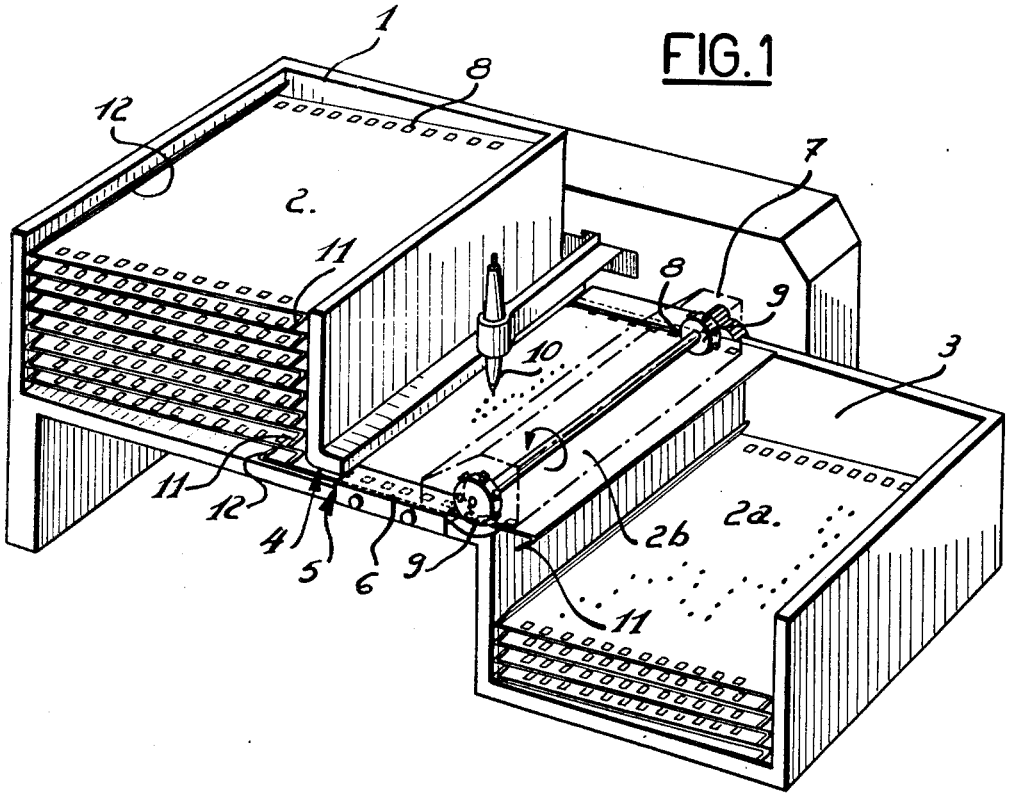
FIG. 1 illustrates a first embodiment of a recorder in which the paper sheets are transferred from a first horizontal pile onto a second horizontal pile.

FIG. 1 illustrates a first recording apparatus comprising a first container 1 for the stocking of a blank sheets or cards pile 2 and a second container 3 for the stocking of a printed or perforated sheets pile 2*a*.

In order to go from the first container 1 to the second container 3, the sheets or cards 2 pass through a slot 4, lying on a flat surface 5 where they are maintained in position by means of guides 6 and pass beneath a driving device 7 before failing into the container 3.

In the embodiment shown, the sheets or cards 2 are provided with lateral side perforations 8 cooperating for the driving of the sheets with toothed rollers 9 driven in rotation by means of a motor (not shown).

A point by point tracing element 10 is provided for registering the desired graph over the sheet passing on the surface 5.

In the blank sheets container 1, each sheet 2 comprises a first fold 11, its fore border bent downward and in direction of the rear of the sheet, said fold extending along the whole fore border of the sheet and perpendicularly to the moving direction of said sheet. Each sheet 2 comprises further a second fold 12, bent upwards and towards the rear border of said sheet 2, that is in the opposite direction to the first fold 11.

The bottom sheet 2*b* in the container 1 passes through the slot 4, under the guides 6 and is driven by the toothed rollers 9 which cooperate with the perforations 8 of said sheet. During the travel of this sheet, its rear fold 12 is sliding under the sheet 2 which is disposed immediately above, until this fold 12 enters to contact with the fold 11 of the fore border of said sheet 2. Since due to the piling up and the weight of the sheets, the folds 11 and 12 cannot be unfolded, the sheet 2*b* carries along a blank sheet 2. Said sheet 2 is carried along by the sheet 2*b* until said sheet 2*b* leaves the toothed rollers 9 and said sheet 2 cooperates then with said rollers 9. At this time, the sheet 2*b* falls into the container 3 on the pile of printed sheets 2*a*. During the travel of the sheets, the guides 6 are also used for preventing the opening of the folds 11 and 12.

This driving method continues in the same manner. The user may at any time add blank sheets in the first container 1 or draw out the sheets of the container 3. The priming of a new blank sheets stock is easily carried out by sliding a sheet in the opposite direction under said stock.

The advantages of this transfering process are obvious:

A power saving is realized, because two sheets at most are driven at the same time, preferably only one sheet. This makes it possible to use batteries which will power the recording apparatus for a year or more.

It is possible to obtain documents or recordings by time unit, this being important especially in the case of calendars or barographs, as well as for several other applications.

It is also possible to draw out recorded sheets and to supply the stock with blank sheets during the operation of the apparatus, that is without interrupting the recording progress.

The study of the recorded documents is much easier, because they are in the form of a pile of individual cards and not in the form of an endless roll.

The principle of this transferring process lies in the folds 11 and 12 in the fore and rear borders of each sheet or card, this allowing the carrying along by each card of the next card.

In the case where it is important, for interpreting the results, to have at ones disposal a graph covering a determinate time unit, one day, one week, etc., it is possible, by adjusting the length of the sheet 2 and the driving speed, that is the rotational speed of the rollers 9, that a sheet exactly corresponds to the desired time unit.

Figure 2:
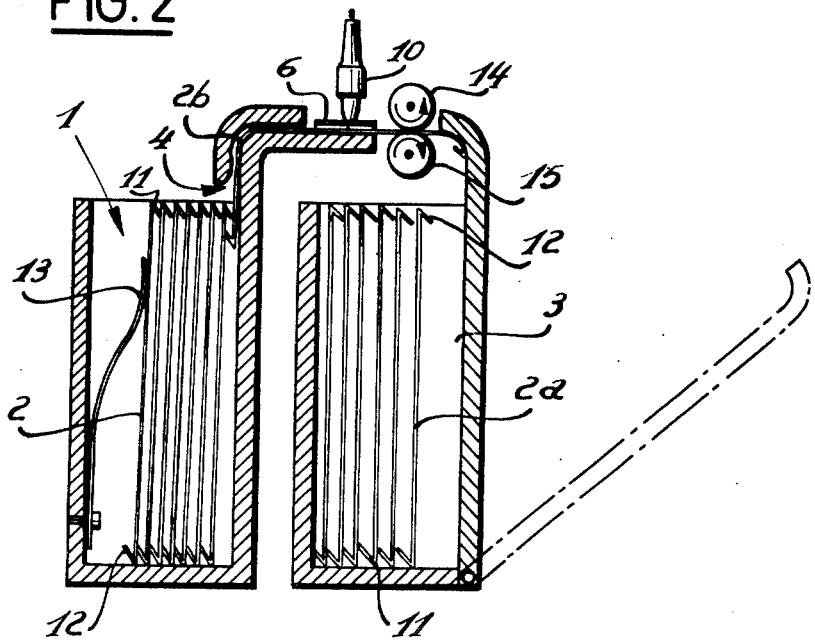
FIG. 2 illustrates a second recording apparatus in which the sheets are stored vertically before and after printing.

In the apparatus shown in FIG. 2, the containers 1 and 3 are intended to vertically receive the sheets or cards 2.

A blade spring 13 keeps the sheets 2 against each in the container 1.

In this embodiment, the driving is carried out by means of two rolls 14, 15, pinching a sheet between them. It is thus not necessary that these sheets be perforated.

These two embodiments require the use of a point by point printing element, because this printing element must not be an obstacle to the passage of the fore border of the sheet.

In both of the following embodiments, this drawback is eliminated due to the fact that the fore border of the sheet which is carried along by the previous sheet is disposed under the rear border of said previous sheet. In this case, the printing element may without any drawback permanently rest on the card.

In FIG. 3, the first container 1 receives blank sheets 2 horizontally piled up. These sheets 2 are subjected to the action of a blade spring 16 which presses them against the underside of a cover 17 of this container 1. The container 3 receives vertically the printed sheets 2*a*.

In FIG. 4, the containers 1 and 3 receive the sheets 2 respectively 2*a* horizontally, and are superimposed. A blade spring 18 maintains the sheets 2 in position. The lower sheet of the container 1 is passing through a slot 19 which leads it onto the upper surface of the container 3, which is also used as the printing surface, then said lower sheet passes under the guides 6 before cooperating with the toothed rollers 9. A baffle-plate 20 guides the sheets around the rollers 9 and into the container 3.

The last embodiment shown in Figure is provided to allow the circulation of the supports in both directions.

Figure 5:
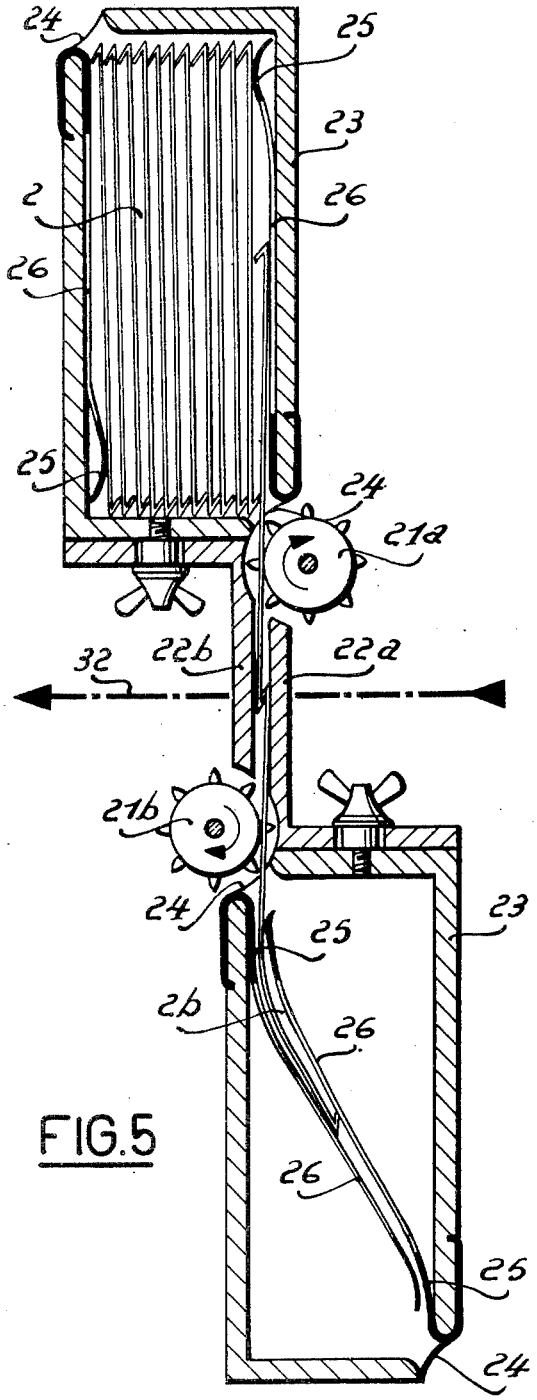
FIG. 5 illustrates a device usable as a sheet or card perforating-reading apparatus in which the cards can move in both directions, and as an apparatus for the projection of diapositives.

The cards or sheets 2, 2*b* provided with at least a perforation line can pass in both directions from one box to the other by means of two toothed rollers 21*a* and 21*b*, the one transporting the cards in one direction, the other in the opposite direction, and the inactive roller turning freely. Both guides 22*a* and 22*b* prevent the folds from opening, hold the perforating element and/or the optical reader (not shown) and are used as a support for both identical boxes 23, these latter being fixed in a removable manner on said guides by any means (blade spring devices, snaps, screws, etc.), for example through nuts as shown in FIG. 5.

The boxes 23, preferably made of a transparent material, are provided in two opposite corners with two slots 24 and in two lateral side walls with two blade springs 25, which maintain the cards in a correct position for backward and forward motion and which are preventing them from sliding out of the boxes.

The content identification of the box is made by means of a written text on the first and on the last card, which are used also for the priming, and which can be read through the openings 26 provided in the blade springs 25. The boxes are fed by introducing the cards through the slots 24. Thanks to such a system and to the proposed box, it is possible to realize on perforated cards the programme actually made on perforated bands. It is thus possible to use the perforated cards by assembling them to form a part of or a complete programme. This programme when composed is then nevermore handled by hand. It can be easily identified and stored.

Figure 6:
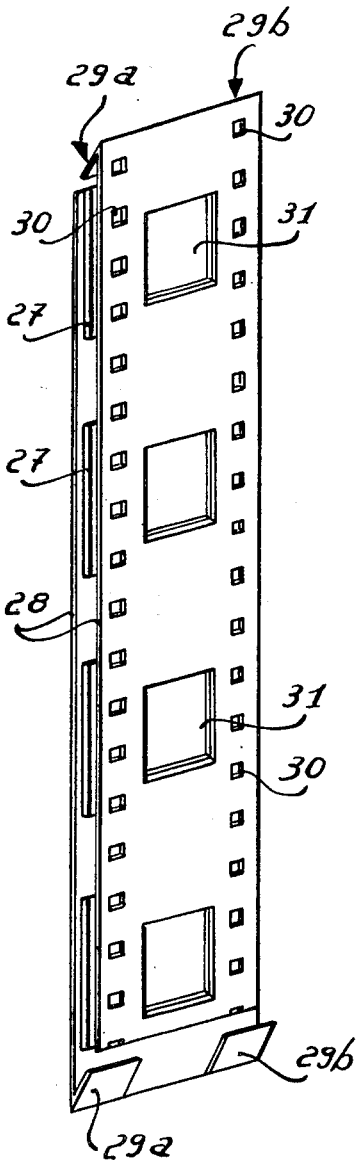
FIG. 6 illustrates a composite sheet for the projection of dias, usable with the device according to FIG. 5.

Finally, FIG. 6 illustrates a support intended for the projection of diapositives or slides, and is usable with the device which has been described with reference to FIG. 5.

The diapositives 27 are fixed by means of glue, rivets or any other means between two non-transparent bands 28, which are each folded on only one border and at the lateral ends 29 to 29*b* of their width, that is in the prolongation of their perforated parts.

In order to secure the precise position of the diapositives, the perforations 30 of the slides 27 are brought into coincidence with those of the two bands 28. The support is provided with openings 31 allowing the passage of the light.

The device and the boxes shown in FIG. 5 are quite appropriate to the projection of slides mounted on such supports.

The passage from a horizontal slide to a vertical slide is realized by pivoting the guide 22, the boxes 23 and the transporting system 21 by 90° around the optical axis 32 (see FIG. 5) on which the projector is also disposed (not shown).

The sheets, cards, etc. used as supports may be made of paper, strong paper, cardboard, plastic, etc., and may comprise a preprinted coordinate system. In other embodiments (not shown), the sheets, cards, etc., may comprise at each of their respectively fore and rear border two folds formed for example at the lateral side ends of their width, instead of a fold on the whole width.

In any case, the folds are not completely closed, but comprise flanges forming an acute angle with the plane of the support, this being necessary in order to ensure a good driving of the supports.

The safest and the precisest paper transport is that using perforated bands. This manner of transport is practically compulsory for long term meterological recordings (of several months without interruption) requiring very long paper bands.

It is known that great difficulty with the perforated papers is their dilatation under wet conditions and their contraction under dry conditions.

These features mean that the teeth of the driving roller are no longer centered in the holes and rip the paper which cannot move forward correctly or which cannot move forward at all. The effect of poor registry is cumulative from hole to hole, each hole being a little more discentered. The longer the band is, the more this effect will certainly appear.

The process according to the invention remedies this disadvantageous situation, in that the cumulative effect is avoided by the use of papers of small length which are automatically centered on the roller, each new sheet sliding forward with regards to the previous sheet and taking up then the accumulated gap.

By making the folds a little too small, that is by very slightly spacing the last hole of a sheet from the first of the following sheet, an "elastic" band is obtained which counter-balances for each sheet any possible lengthening or shortening of the paper. The present system provides therefore a resolution of this problem which is very serious in the case of longlife recordings in the open air.

The provision of a series of sheets or cards also permits different printings on each sheet, for example for the realization of a calendar, this being not possible with paper rolls, the printing thereof requiring then cylinders of too great a diameter.

I claim:

1. A process for transferring supports, characterized by the fact that a support is mechanically driven by means of a driven device and that said mechanically driven support drives at least the next support by means of at least a fold formed on at least a part of the rear border width of said support and coming during its travel motion into coupling with at least another fold, which is formed in the opposite direction to said rear border fold of the previous support, and on at least a part of the fore border width of said next support.

2. A process according to claim 1, characterized by the fact that the length of the supports and their driving speed are adjusted in order to obtain a determinate time unit for said supports.

3. A process according to claim 1, characterized by the fact that said supports are driven in only one direction.

4. A process according to claim 1, characterized by the fact that said supports are indifferently driven in both directions.

5. Supports adapted to be fed in serial fashion with the forward support drawing after it the next support, characterized by the fact that they comprise each a single flat leaf having fore and rear borders, a fold on at least part of said fore border and a fold on at least part of said rear border, said folds being disposed on opposite sides of their associated leaf and extending toward each other and terminating in free edges that are spaced apart a substantial distance from each other, there being a plurality of separate said supports all oriented in the same way in a stack.

6. Supports according to claim 5, characterized by the fact that they comprise longitudinal perforations for the driving thereof.

7. Supports according to claim 5, characterized by the fact that they consist in sheets or cards.

8. Supports according to claim 7, characterized by the fact that they comprise a preprinted coordinate system.

9. Supports according to claim 7, characterized by the fact that said sheets or cards are made of paper, cardboard or plastic material.

10. Supports according to claim 5, characterized by the fact that they comprise each two folds at two lateral side ends of their fore border and two folds, bent in the opposite direction at the lateral side ends of their rear border.

11. Supports according to claim 5, characterized by the fact that they comprise each a fold on the whole width of their fore border and a fold bent in the opposite direction on the whole width of their rear border.

* * * * *